US006078342A

United States Patent [19]

Wen et al.

[11] Patent Number: 6,078,342

[45] Date of Patent: Jun. 20, 2000

[54] THERMAL RESISTIVE PRINTING FLUORESCENT POSTAGE STAMPS

[75] Inventors: Xin Wen, Rochester; William Y. Fowlkes, Pittsford, both of N.Y.

[73] Assignee: Eastman Kodak Company, Rochester, N.Y.

[21] Appl. No.: 09/388,871

[22] Filed: Sep. 2, 1999

[51] Int. Cl.[7] ..... B41J 2/235

[52] U.S. Cl. ..... 347/171; 347/217; 347/221; 347/176

[58] Field of Search ..... 347/171, 172, 347/174, 176, 217, 221; 428/195, 480, 913, 914

[56] References Cited

U.S. PATENT DOCUMENTS 3,592,326 7/1971 Zimmerle .
4,866,025 9/1989 Byers et al. .
5,176,458 1/1993 Wirth .
5,841,459 11/1998 Wen .

*Primary Examiner*—Huan Tran
*Attorney, Agent, or Firm*—Raymond L. Owens

[57] ABSTRACT

Thermal resistive printing apparatus for printing a fluorescent postal stamp image on a receiver in response to a digital image includes a donor web carrying at least one visible colorant material under visible light and an invisible fluorescent material which when illuminated by light in a predetermined portion of a spectrum, emits light in a different portion of the spectrum and a receiver for receiving colorant material and fluorescent material from the donor web and the receiver having a plurality of receiver portions in which the stamp images are to be formed. The apparatus further includes a thermal resistive head including a plurality of thermal resistive elements responsive to the digital image for selectively applying heat to the donor web so that colorant material and fluorescent material are transferred from the donor web to the plurality of portions on the receiver to form fluorescent postal images.

8 Claims, 2 Drawing Sheets

THERMAL RESISTIVE PRINTING FLUORESCENT POSTAGE STAMPS

CROSS REFERENCE TO RELATED APPLICATIONS

Reference is made to commonly assigned U.S. patent application No. 09/103,019 filed Jun. 23,1998, entitled "FORMING AUTHENTICATED IMAGES IN A RECEIVER" to Paz-Pujalt et al. The disclosure of this related application is incorporated herein by reference.

FIELD OF THE INVENTION

The present invention relates to printing postage stamps using a thermal resistive printer.

BACKGROUND OF THE INVENTION

Postal stamps can be printed by gravure, intaglio, offset, and flexo techniques. The official postage stamps are commonly printed using a Gravure process. The Gravure process is capable of creating images of very high resolution, beyond the capabilities of most common printers. The Gravure process is an intaglio process. It uses a depressed or sunken surface etched into a copper cylinder to create the image and the unetched surface of the cylinder represent non-printing areas. The cylinder rotates in a bath of ink and the etched area picks up the ink and transfers it to the media creating the image. Gravure printing is considered excellent for printing highly detailed marks or pictures.

The high set-up cost (including making the cylinders etc.) of the Gravure printing process makes it not economic for printing small quantities of stamps, for example, batches from about 10 to 1000. This prohibits a consumer from choosing an image and having a postage stamp created using that image. It also does not permit a consumer to choose an image from a gallery of images that have been previously approved and having a postage stamp created using that previously approved image.

The postal stamps are required to include fluorescent or phosphorescent materials for aligning the mail to the proper orientation in the mail sorting process. In the mail sorting process, as disclosed in U.S. Pat. No. 3,592,326, the mail envelopes pass through a so-called automatic facing machine in which the mail envelopes are illuminated by a UV light source (as specified by postal authority). The fluorescent or phosphorescent materials in the stamp emits in the visible wavelength (also as specified by the postal authority). The emitted fluorescent light must be detected by a detector for the mail envelope to pass through. If the fluorescent detector does not detect fluorescent or phosphorescent materials in the facing machine, the mail envelope is diverted out of the normal path of the mail and is reoriented and again passed through the facing machine to ensure that it is then properly oriented. This process can be repeated until the facing machine finally detects that the envelope is properly oriented. The automatic orientation detection and alignment significantly increase the throughput of the mail handling facilities.

SUMMARY OF THE INVENTION

An object of this invention is to provide a digital printing apparatus that can print fluorescent stamp images on a receiver to form stamps that can be adhesively applied to mails.

A further object of the present invention is to provide fluorescent or phosphorescent materials in the stamps formed by a thermal resistive printing process and the mails carrying these stamps permit effective mail sorting.

These objects are achieved by thermal resistive printing apparatus for printing a fluorescent postal stamp image on a receiver in response to a digital image, comprising:

a) a donor web carrying at least one visible colorant material under visible light and an invisible fluorescent material which when illuminated by light in a predetermined portion of a spectrum, emits light in a different portion of the spectrum;

b) a receiver for receiving colorant material and fluorescent material from the donor web and the receiver having a plurality of receiver portions in which the stamp images are to be formed;

c) a thermal resistive head including a plurality of thermal resistive elements responsive to the digital image for selectively applying heat to the donor web so that colorant material and fluorescent material are transferred from the donor web to the plurality of portions on the receiver to form fluorescent postal images.

ADVANTAGES

An advantage of the present invention is that the postal stamps with easily variable image patterns are provided which include fluorescent or phosphorescent materials that are compatible with the existing mail sorting process.

A further advantage of the present invention is that the high-quality continuous-tone postal stamps are printed on peelable portions of a receiver. These peelable stamps can be peeled off the receiver and adhesively fixed to mail.

A further advantage of the present invention is that the fluorescent or phosphorescent materials in the receiver or the donor web can be particularly selected for the spectral characteristics to deter counterfeiting.

Yet another advantage of the present invention is that the fluorescent donor web or receiver can be manufactured specifically for the postal printing application so that they are not available for general use, which reduces the possibility of counterfeiting.

DETAILED DESCRIPTION OF THE INVENTION

The present invention is described in relation to a thermal resistive printing apparatus for printing postal stamps for adhesively applying to envelopes, wherein the stamp pattern can be conveniently varied. In the present invention, the terminology "stamp" refers to a receiver sheet that carries an authenticated postal image including images and postage amount.

Figure 1:
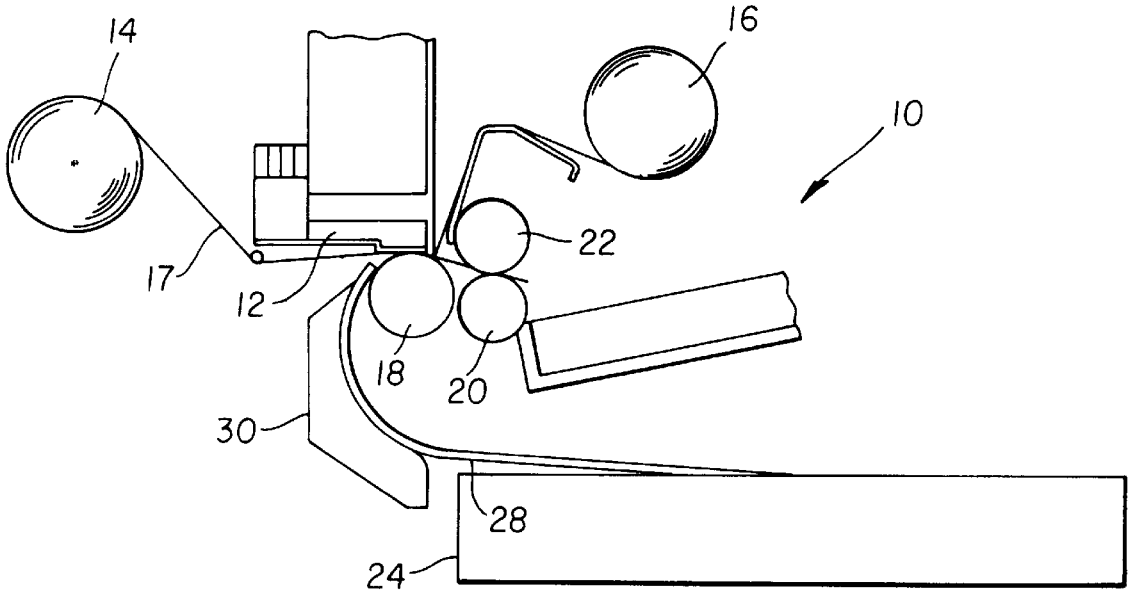
FIG. 1 is a partial schematic showing a thermal resistive printer in accordance with the present invention.

Referring to FIG. 1, a thermal resistive printer 10 in accordance with the present invention includes a print head assembly 12, a supply spool 14 and take-up spool 16 for supply and transporting a donor web 17. The print head assembly 12 includes a plurality of resistive heating elements, each of which can print image pixels on a receiver. The donor web 17 is coated with colorant materials that can be transferred by the print head assembly 12 to a receiver. The colorant materials are visible under the illumination of visible light. For the best image quality and best appeal to the users, the colorant materials are preferably dye molecules in the present invention.

Figure 3:
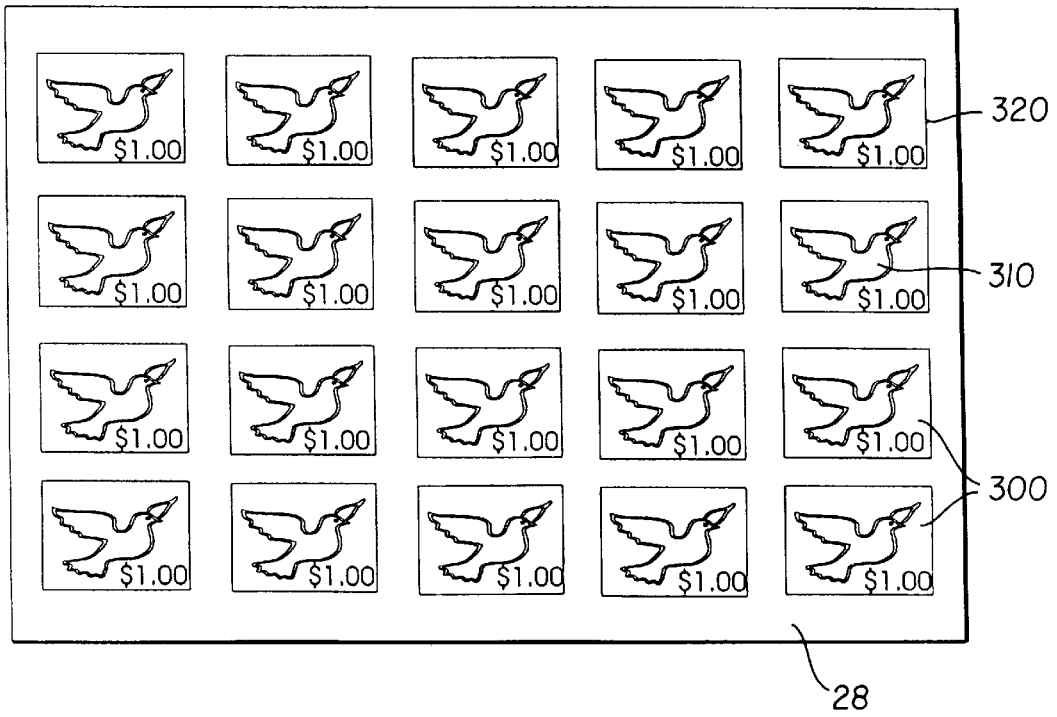
FIG. 3 shows a receiver sheet carrying peelable images printed by the thermal resistive printer in FIG. 1.

The thermal resistive printer 10 also includes a roller platen 18 for providing the pressure and compliance to the receiver sheet 28 and donor web 17 during printing, a pair of pinch rollers 20 and 22 for driving the receiver sheet 28, a receiver tray 24 for storing and supplying the receiver sheets 28, and a receiver guide 30 for guiding the receiver during transport. The receiver sheet 28 includes a colorant (dye) receiving layer that can receive colorant material from the donor web 17 under heat and pressure. The receiver sheet 28 also preferably includes a substrate and peelable receiver portions 300 comprising the colorant receiving layer (FIG. 3). The peelable receiver portions 300 can be peeled off from the substrate after stamp images are formed on them. Preferably, the thermal resistive printer 10 is a dye-diffusion (also referred to as dye-sublimation) printer that is cable of continuous tone printing of photo quality images. It is well known in the art that thermal resistive dye-diffusion printer can provide photographic quality images that the other common thermal transfer printers cannot provide.

In the printing process, the receiver sheet 28 is loaded from the receiver tray 24. The receiver sheet 28 is transported by the pinch rollers 20 and 22 through the receiver guide 30 while the print head assembly 12 is in an "up position" leaving a gap for the receiver sheet 28 to be transported underneath. After the receiver sheet 28 is transported to the correct position, the print head assembly 12 is lowered to a "down position" which forms a pressure interface (nip) between the print head assembly 12, the donor web 17, the receiver sheet 28, and the roller platen 18. The print head assembly 12 subsequently prints a dye image on the receiver sheet 28 by thermally activating the diffusion of dye molecules from the donor web 17 to the receiver sheet 28. The dye image 310 (FIG. 3) is transferred from each color patch (see FIG. 2) in an image-wise pattern corresponding to the image content in the specific color plane. The lamination material is then uniformly transferred from the lamination patch 210 (FIG. 2) over the dye image 310 (FIG. 3) printed on the receiver sheet 28. The lamination layer on the receiver sheet 28 protects the printed dye image 310 from physical abrasion, finger print and light fade. The receiver sheet 28 carrying the dye images 310 is finally ejected from the print head assembly 12.

Details of the thermal resistive printing are also disclosed in the commonly assigned U.S. Pat. No. 5,176,458 Wirth and U.S. Pat. No. 5,841,459 to Wen. The disclosures in these patents are hereby incorporated by reference.

The image printed on the peelable receiver portion 300 (FIG. 3) in the receiver sheet 28 can include the country of issue, denomination (postage), other postal indicia such as images stored in the database of the postal authority. The image printed on the peelable receiver portion 300 can also include userselected or user-produced images and annotations that are approved by the postal authority. The personally selected or personally created images are appealing to many users. Encrypted information can be included to enhance security and authentication of the stamp. Information can also be coded to permit automatic detection and extraction of coded information.

Figure 2:
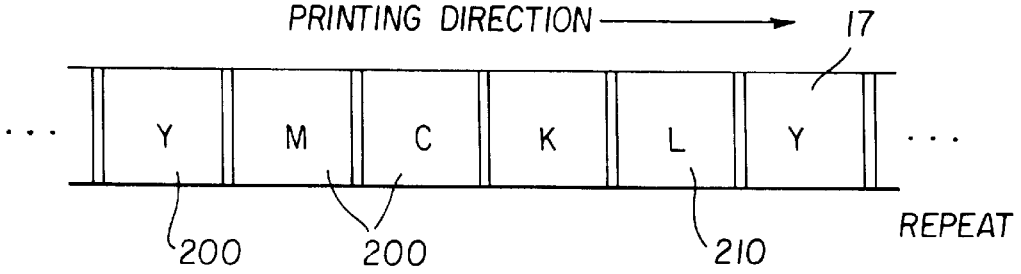
FIG. 2 shows the layout of a donor web of FIG. 1, including different colored dye and lamination patches. The patches can include fluorescent or phosphorescent materials that can be transferred to the receiver sheet.

Referring the FIG. 2, the donor web 17 includes a sequence of yellow (Y), magenta (M), cyan (C), and black (K) color dye patches 200. A lamination patch 210 (L) is often included for providing a protection sheet over the printed dye image 310 (FIG. 3) on the receiver sheet 28. Each group of the Y, M, C, K and L patches (200,210) are used for producing one set of color dye images 310 on the receiver sheet 28.

In the present invention, at least one dye patch 200 or a lamination patch 210 in the donor web 17 includes fluorescent or phosphorescent materials that can be transferred to the receiver sheet 28 by the print head assembly 12. The lamination and the fluorescent materials can be transparent such that the optical densities and color balance of the printed dye image 310 are not altered. In one embodiment of the present invention, the fluorescent or phosphorescent materials are coated in the lamination patch 210 and uniformly transferred over the printed dye image 310 together with the lamination material. The distribution of the fluorescent or phosphorescent materials in this embodiment is independent from the printed dye image pattern (overlap, partially overlap, or separated). One advantage of this embodiment is that the fluorescent material can be printed over an area larger than the printed dye image 310, which enhances the detection signal-to-noise ratio.

In a different embodiment of the present invention, the fluorescent or phosphorescent materials in the lamination sheet are printed in an image pattern that can be a sign, text or a machine readable symbol such as a barcode. This image is invisible to human eye under visible lighting conditions. The fluorescent image pattern can be different from the dye image 310. The fluorescent image pattern can include non-variable and variable portions with the variable portions customized to the specific design of the postage or its application. Since the fluorescent or phosphorescent images are visible only under exposure to light at specific wavelengths, these images enhance the securities of the mails and can deter counterfeiting.

In the present invention, the term "fluorescent material" refers to materials that when illuminated by light in a predetermined portion of a spectrum, preferably UV light, emits light in a different portion of the spectrum. In the present invention, fluorescent material also includes phosphorescent materials that can emit light after the illumination is stopped. The emitting light is preferably in the visible spectrum. As described above, the fluorescence of the stamp can facilitate effective mail sorting in the existing mail handling process.

In another different embodiment of the present invention, the fluorescent or phosphorescent materials are incorporated in the dye patches 200 and is transferred to the receiver sheet 28 together with the colorant material during the printing in an image-wise pattern.

Many fluorescent materials known or commercially available are compatible with the present invention. One example of the fluorescent material is the diphenylpyrazoline compounds disclosed in commonly assigned U.S. Pat. No. 4,866,025 to Byers et al. Other examples of these materials include oxazole compounds, aminocoumarin compounds, europium complexes, naphthalimide compounds, aminocarbostyrils compounds, and polycyclic-aromatic compounds. The fluorescent materials are typically dispersed in a polymer binder similar to the dye molecules in the donor web 17.

The fluorescent materials usually need to be selected according to the requirements of the Postal Authority. The absorption and emission spectral characteristics can also be particularly selected for deterring counterfeiting. The fluorescent donor web or receiver can be manufactured specifically for the postal printing application so that they are not available for general use, which also reduces the possibility of counterfeiting.

The receiver sheet 28 of FIGS. 1 and 2 is shown in more detail in FIG. 3. The receiver sheet 28 includes one or a multiple of perforated peelable receiver portions 300. In the process as described above, a dye image 310 is printed on each peelable receiver portion 300 to form a peelable fluorescent postal stamp 320 by the thermal resistive printer 10. By use of the term "fluorescent postal stamps" is meant a postal stamp which includes a visible dye image 310 that is visible under the illumination of visible light, and a fluorescent portion, which can be an image, that is formed of fluorescent material which when illuminated by light in a predetermined portion of a spectrum, emits light in a different portion of the spectrum.

Yet in another embodiment of the present invention, fluorescent or phosphorescent materials is pre-coated in the receiver sheet 28 in the receiver manufacturing process. One example of these materials is the oxazole compounds. Another example is inorganic fluorescent pigments that include $Zn_2SiO_4$:Mn or ZnS:Cu materials. It is understood that different embodiments of the present invention can work in combination to enhance the detection signal.

Figure 4:
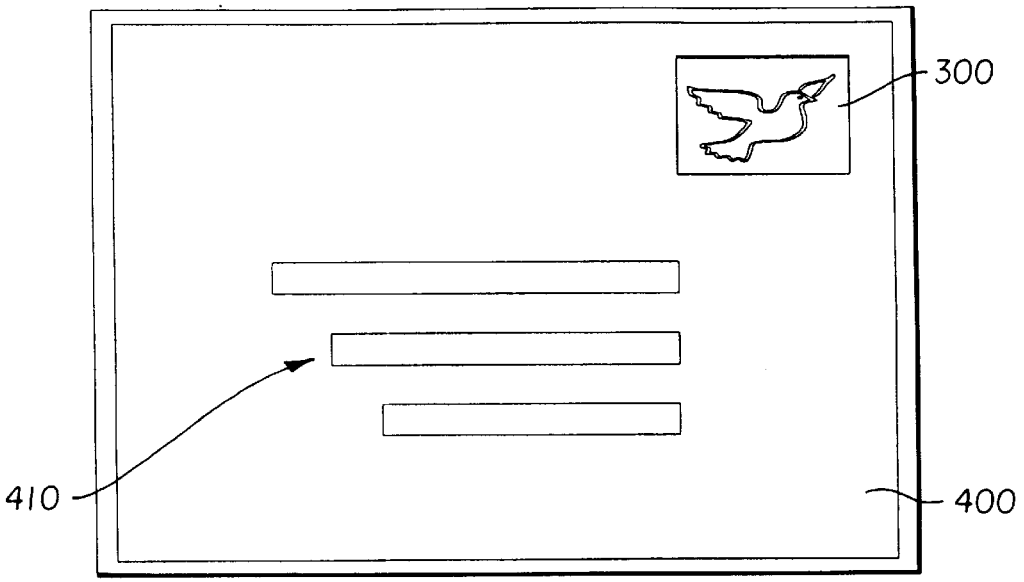
FIG. 4 shows the layout of a mail envelope including a mailing address and a postal stamp that is peeled off from the receiver sheet in FIG. 3.

After the dye images are formed, a peelable stamp can be peeled off from the receiver sheet 28 and be adhered to a mail envelope 400 as shown in FIG. 4. The mail envelope 400 includes a mailing address 410 and the attached peelable. Preferably, the peelable stamp 320 contains self-adhesive on the back surface so that no adhesive is required to attach it to the envelope 400.

The stamps made as described in the above disclosure permit the orientation of the stamped mail to be detected by the fluorescence detector in the facing machine in the mail sorting process. The amount or level of the fluorescent or phosphorescent materials on the stamp can be varied so that the signal-to-noise ratio in the detection is optimized.

The invention has been described in detail with particular reference to certain preferred embodiments thereof, but it will be understood that variations and modifications can be effected within the spirit and scope of the invention.

| PARTS LIST | |
|---|---|
| 10 | thermal resistive printer |
| 12 | print head assembly |
| 14 | supply spool |
| 16 | take-up spool |
| 17 | donor web |
| 18 | roller platen |
| 20 | pinch roller |
| 22 | pinch roller |
| 24 | receiver tray |
| 28 | receiver sheet |
| 30 | receiver guide |
| 200 | dye patch |
| 210 | lamination patch |
| 300 | peelable receiver portion |

-continued

| PARTS LIST | |
|---|---|
| 310 | dye image |
| 320 | peelable fluorescent postal stamp |
| 400 | mail envelop |
| 410 | mailing address |

What is claimed is:

1. Thermal resistive printing apparatus for printing a fluorescent postal stamp image on a receiver in response to a digital image, comprising a) a donor web carrying at least one visible colorant material under visible light and an invisible fluorescent material which when illuminated by light in a predetermined portion of a spectrum, emits light in a different portion of the spectrum;

b) a receiver for receiving colorant material and fluorescent material from the donor web and the receiver having a plurality of receiver portions in which the stamp images are to be formed;

c) a thermal resistive head including a plurality of thermal resistive elements responsive to the digital image for selectively applying heat to the donor web so that colorant material and fluorescent material are transferred from the donor web to the plurality of portions on the receiver to form fluorescent postal images.

2. The apparatus of the claim 1 wherein the donor web includes dye patches and lamination patches.

3. The apparatus of the claim 2 wherein the dye patches in the donor web includes fluorescent material.

4. The apparatus of the claim 2 wherein the lamination patch in the donor web includes fluorescent material.

5. The apparatus of the claim 1 wherein the fluorescent materials are printed in an image pattern.

6. The apparatus of the claim 1 wherein the receiver includes a plurality of perforated peelable portions in which the stamp images are formed.

7. Thermal resistive printing apparatus for printing a fluorescent postal stamp image on a receiver in response to a digital image, comprising a) a donor web carrying at least one visible colorant material under visible light;

b) a receiver for receiving the colorant material from the donor web and the receiver having a fluorescent material which when illuminated by light in a predetermined portion of a spectrum, emits light in a different portion of the spectrum;

c) a thermal resistive head including a plurality of thermal resistive elements responsive to the digital image for selectively applying heat to the donor web so that the colorant materials are transferred from the donor web to the receiver to form a fluorescent postal image.

8. The apparatus of the claim 7 wherein the receiver includes perforated peelable portions in which the stamp images are formed.

* * * * *